United States Patent [19]

Martin et al.

[11] Patent Number: 4,657,144

[45] Date of Patent: Apr. 14, 1987

[54] METHOD AND APPARATUS FOR DETECTING AND REMOVING FOREIGN MATERIAL FROM A STREAM OF PARTICULATE MATTER

[75] Inventors: Peter Martin, Richmond; Avis N. Wyatt, Jr., Chester; Hector Alonso, Richmond; Norman R. Rowe, Chester; Robert S. Southard, Chesterfield; Stephen G. Zimmermann, Richmond, all of Va.

[73] Assignee: Philip Morris Incorporated, New York, N.Y.

[21] Appl. No.: 705,127

[22] Filed: Feb. 25, 1985

[51] Int. Cl.[4] ..... B07C 5/342; A24C 5/39; A24C 5/36

[52] U.S. Cl. ..... 209/546; 209/581; 209/587; 209/639; 131/108; 131/110; 131/905; 131/290; 131/96

[58] Field of Search ..... 131/290, 96, 108, 326, 131/312, 110, 905; 209/587, 639, 567, 577, 546, 548, 580, 581, 587

[56] References Cited

U.S. PATENT DOCUMENTS

| | | | |
|---|---|---|---|
| 3,472,375 | 10/1969 | Mathews | 209/74 |
| 3,489,277 | 1/1970 | Silverman | 209/587 |
| 3,685,650 | 8/1972 | Walther et al. | 209/74 |
| 3,782,544 | 1/1974 | Perkins, III | 209/587 |
| 3,901,388 | 8/1975 | Kelly | 209/111.7 |
| 4,262,806 | 4/1981 | Drabs | 209/587 |
| 4,352,430 | 10/1982 | Maier et al. | 209/581 |
| 4,513,868 | 4/1985 | Culling et al. | 209/587 |

FOREIGN PATENT DOCUMENTS

| | | | |
|---|---|---|---|
| 2609812 | 9/1977 | Fed. Rep. of Germany . | |
| 1804881 | 1/1979 | Fed. Rep. of Germany | 209/576 |
| 2902901 | 7/1980 | Fed. Rep. of Germany . | |
| 1449021 | 9/1976 | United Kingdom . | |
| 2119509 | 11/1983 | United Kingdom . | |

*Primary Examiner*—V. Millin
*Assistant Examiner*—H. Macey
*Attorney, Agent, or Firm*—Jeffrey H. Ingerman

[57] ABSTRACT

A method and apparatus are provided for detecting and removing foreign material which may be found in a stream of particulate matter, such as tobacco. The tobacco is allowed to fall in a cascade past an optical detector. The turbulence of the falling motion brings a large proportion of the particles in the cascade into the field of view of the detector. When foreign material is detected, a signal is generated to activate a fluid blast directed at the portion of the cascade in which the foreign material is located.

20 Claims, 5 Drawing Figures

METHOD AND APPARATUS FOR DETECTING AND REMOVING FOREIGN MATERIAL FROM A STREAM OF PARTICULATE MATTER

BACKGROUND OF THE INVENTION

This invention relates to a method and apparatus for separating components that are mixed in a single flowing stream of particulate material. In particular, this invention relates to a method and apparatus for detecting and removing foreign material from a stream of leaf tobacco, strip tobacco, or cut tobacco lamina filler.

Tobacco as delivered to a processing line for processing into filler or cigarettes may contain foreign matter such as pieces of the hogsheads in which it is shipped and stored, bits of string and paper, and other items. Various methods and apparatus have been used to remove these materials, including, e.g., manual observation and sorting, screens and metal detectors. However, these methods and apparatus cannot detect all forms of non-tobacco materials and many cannot operate at the high speeds characteristic of tobacco processing equipment.

It is known that certain non-tobacco materials and tobacco which is not of a desired color can be detected by optical scanning. For example, when defective cigarettes are rejected from a cigarette making machine, they are routed to ripping machines, or "rippers," which break them up and separate the tobacco filler from the cigarette paper for re-use. Some of the cigarette paper may not be removed and may be present in the tobacco filler separated by the ripper. A system exists which optically scans a layer of tobacco filler from a ripper as it travels on a conveyor belt to detect the paper. The tobacco filler is illuminated and the white paper reflects more light than the tobacco filler. The tobacco filler conveyor ends a short distance beyond the scanner, and the scanned filler is allowed to fall past an array of air nozzles. The nozzles are automatically activated to deflect those portions of the falling tobacco stream in which paper was detected by the scanner, the time needed for a particular portion of the tobacco stream to reach the air nozzles after passing the scanner being known. The deflected tobacco can then be hand-sorted to remove the paper, and put back onto the production line.

In a similar known system, leaf tobacco is inspected on a conveyor by three sensing elements made sensitive to different colors by optical filters. An integrated color mapping of the scanned tobacco is compared to the desired color, and off-color tobacco is rejected using a system such as that described above in which the tobacco falls past air nozzles which are activated automatically.

In both of these systems, tobacco is optically inspected as it passes a sensing device on a conveyor. Therefore, the sensing device will only detect those foreign materials or off-color particles which are present on the surface of the bed of tobacco on the conveyor. As a result, some foreign material will not be detected. Alternatively, a very thin "monolayer" of tobacco can be scanned, but the speed of the conveyor is limited by the speed of the scanner, so that using a monolayer greatly reduces the volume rate at which tobacco can flow through the system. This reduced rate is generally lower than that at which the remainder of the processing equipment on the line can operate and so prevents the equipment from operating at the desired speed.

SUMMARY OF THE INVENTION

It is an object of this invention to provide a method and apparatus for optically detecting and removing foreign material in a stream of particulate matter, such as tobacco, moving at production flow rates.

It is a further object of this invention to provide such a method and apparatus which will detect small pieces of foreign material.

It is still another object of this invention to provide such a method and apparatus which do not require that the particulate matter be in a monolayer.

In accordance with the invention, apparatus for detecting foreign material in a stream of particulate matter is provided, comprising a first conveying means for delivering a stream of particulate matter containing foreign material to the apparatus, and a second conveying means for carrying the stream of particulate matter away from the apparatus. The second conveying means is located below and vertically spaced from the first conveying means, such that the stream of particulate matter is transferred from one to the other by falling between them under the influence of gravity in a cascade. Means are provided for illuminating the cascade as it falls and detecting the reflected light. In apparatus for removing the foreign material, there is also provided a deflecting means including a plurality of nozzles for directing a blast of fluid under pressure at the portion of the cascade of particulate matter in which the foreign material is located.

The method of the invention includes the steps of causing the stream of particulate matter to fall in a cascade having first and second sides, illuminating the first side at a first illuminating height, detecting the reflected light at a first detecting height, comparing the reflected light with the reflected light expected from a stream of the particulate matter free of foreign material and generating a signal when the reflected light indicates the presence of foreign material, and deflecting a portion of the cascade at a first deflecting height in response to the signal.

BRIEF DESCRIPTION OF THE DRAWINGS

The above and other objects and advantages of the invention will be apparent from the following detailed description of the invention, taken in conjunction with the accompanying drawings in which like reference characters refer to like parts throughout and in which.

DETAILED DESCRIPTION OF THE INVENTION

Figure 1:
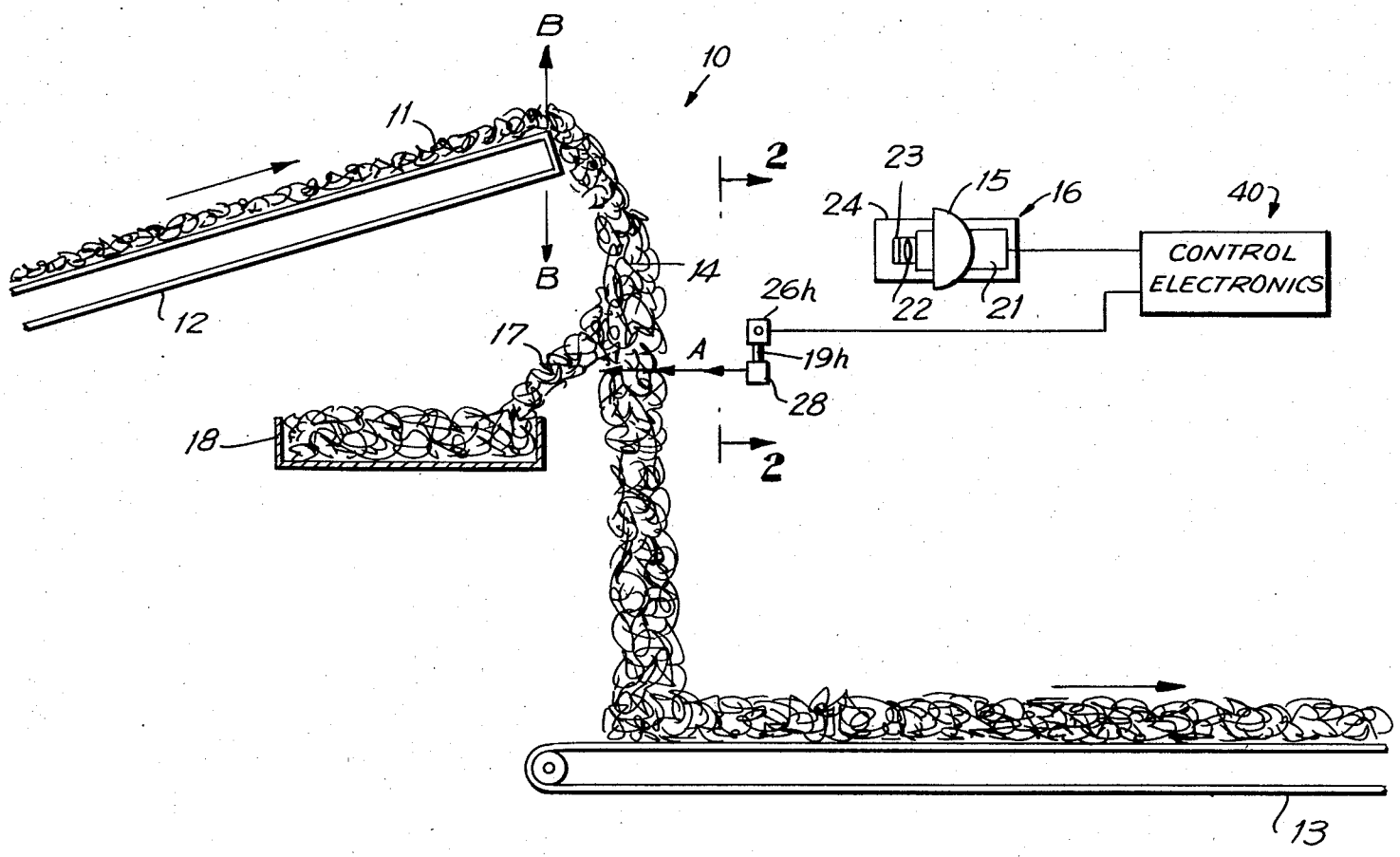
FIG. 1 is a side elevational view of apparatus according to the invention.
Figure 2:
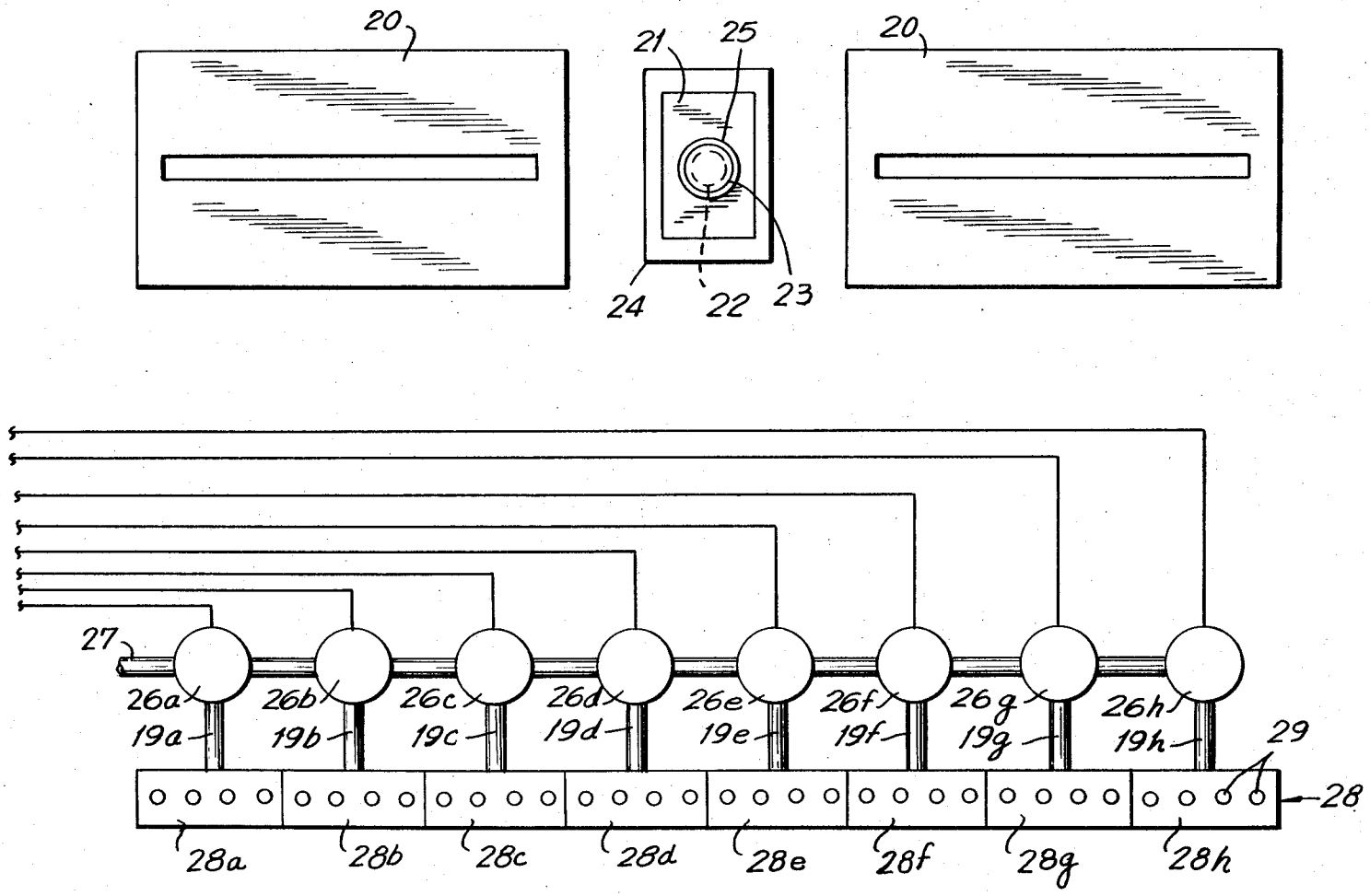
FIG. 2 is a front elevational view of the illuminating, detecting and deflecting means of the invention taken from line 2—2 of FIG. 1.

A preferred embodiment of the apparatus 10 according to the invention is shown in FIGS. 1 and 2. A stream of tobacco 11 containing foreign material (not shown)

such as foil, cellophane, warehouse tags, and paper is delivered from a processing line by conveyor 12. Conveyor 12 is preferably a vibrating inclined conveyor which vibrates as shown by arrows B in FIGS. 1 and 3. Conveyor 12 ends above another conveyor 13, which can be an ordinary conveyor belt, and is spaced vertically above conveyor 13 a sufficient distance to accommodate the remainder of the apparatus described below. As tobacco stream 11 reaches the end of conveyor 12, it drops under the influence of gravity in a cascade 14 to conveyor 13. Because conveyor 12 is inclined, the tobacco stream does not have so great a horizontal velocity when it falls, so that cascade 14 does not have any significant front-to-back horizontal spread.

Cascade 14 is illuminated by light source 15 which is preferably a pair of high-temperature lamps 20, such as metal halide or other high-intensity discharge lamps, which emit an increased percentage of their light in the visible spectrum compared to ordinary incandescent lamps. When choosing the type of light source to be used, one factor to be considered is that heat generated by the light source may damage the material being inspected, so that the heat generated should be minimized as a function of power supplied. Another factor to be considered is that because detection occurs based on the difference in light reflected from the material being inspected and the foreign material, the output intensity of the light source at the wavelength where that difference is greatest should be maximized as a function of power supplied. The illuminated area of cascade 14 is scanned by an optical detector 16 having a matrix of electro-optical detectors which is preferably a line-scan camera 21 having a lens 22 and a filter 23. Detector 16 is preferably kept in a housing 24, shown as transparent, having an aperture 25 opposite lens 22 and filter 23. A slight positive pressure of approximately 2–10 psi is maintained in housing 24 by means not shown to keep optics 21, 22, 23 free of dust.

When detector 16 detects foreign material, control electronics 40 sends a signal to the appropriate valve or valves 26*a–h*, all as described below. Valves 26*a–h* are connected at 27 to a source of high pressure fluid which is preferably air at approximately 80 psi, although other gases, such as steam, or liquids, such as water, can be used. A deflection bar 28 is situated below detector 16 adjacent cascade 14. Bar 28 is hollow, and is divided internally into eight chambers 28*a–h* having holes 29 for directing air against cascade 14. Each chamber 28*a–h* is supplied by one of the valves 26*a–h* through tubes 19*a–h*. When one of valves 26*a–h* opens in response to a signal, a blast of air A is directed by deflection bar 28 against that portion of cascade 14 in which the foreign material was detected to force that portion 17 of the tobacco and foreign material to fall into receptacle 18 for manual sorting, if necessary. Tobacco which has been manually sorted can be returned to the tobacco processing line upstream or downstream of apparatus 10, depending on whether or not rescanning is desired. Alternatively, portion 17 could be deflected to a conveyor that removes it to another area for processing.

Figure 3:
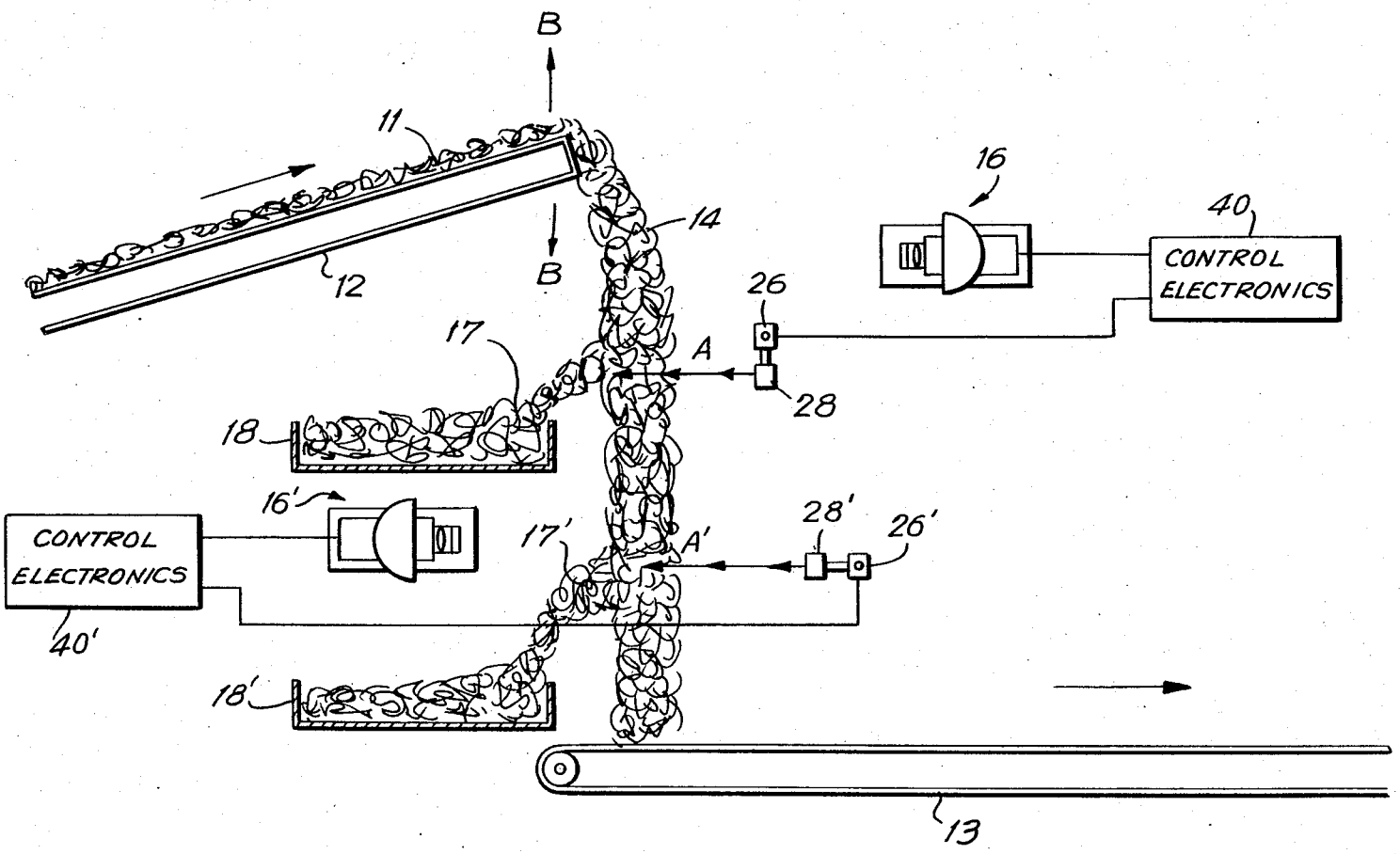
FIG. 3 is a side elevational view of the apparatus of FIG. 1 with a second set of illuminating, detecting and deflecting means.

If desired, a second detector 16' can be used as shown in FIG. 3. Detector 16' can be below detector 16 on either the same or the other side of cascade 14 from detector 16, or it can be at the level of detector 16 on the other side of cascade 14. Associated with detector 16' are a second set of control electronics 40', a second set of valves 26', a second deflection bar 28', and a second receptacle 18'. Deflection bar 28' discharges a blast of air A' to deflect a portion 17' of tobacco and foreign material from cascade 14. Alternatively, detector 16' can be connected to the same deflection bar 28 as detector 16, regardless of which side of cascade 14 detector 16' is located on, provided that detector 16' is above bar 28. Detector 16' can be provided to detect foreign material which might be missed by detector 16, as discussed below, or to detect foreign material with different optical properties, also discussed below.

Apparatus 10 allows tobacco to be processed at greater rates than apparatus in which the tobacco is scanned on a belt. This is because when tobacco is scanned on a belt, it has to be in a "monolayer," or single layer of particles, for all of the particles on the belt to be visible to the detector. However, as the tobacco falls in cascade 14, relative vertical motion between the various particles of tobacco and foreign material is induced by the turbulence of the falling stream, so there is a greater probability that a particular piece of foreign material will be visible to detector 16 at some point in its fall. Relative vertical motion also results if the foreign material is significantly lighter or heavier than tobacco so that it has greater or less air resistance as it falls. Relative vertical motion is enhanced by the vibration of conveyor 12 which brings lighter material to the surface of the tobacco before it falls in cascade 14, making the lighter material, which is usually foreign material, easier to detect, as in a monolayer. The inclination of conveyor 12, in reducing the horizontal spread of cascade 14 as discussed above, also enhances relative vertical motion because the particles in cascade 14 have little or no horizontal velocity component. Any horizontal velocity component that a particle has when it falls off conveyor 12 is small because conveyor 12 is inclined, and air resistance quickly reduces the horizontal motion to near zero. The relative vertical motion allows a relatively thick layer of tobacco to be scanned, so that a greater volume can be scanned per unit of scanning area. Given a constant rate of area scanned per unit time, the increased volume scanned per unit area translates into a higher volume of tobacco scanned per unit time.

Even with the turbulence induced in cascade 14, it is possible that a particular particle of foreign material may not be visible from the side of cascade 14 facing detector 16 while it is within the range of detector 16. For this reason, detector 16' can be provided, as discussed above, to scan the other side of cascade 14 from the same or different height, or to scan the same side at a lower height, to increase the probability of detecting any particle of foreign material not detected by detector 16. Because the obscuring of a particle of foreign material by a particle of tobacco is a random event, the probability of detecting a particle of foreign material increases with the number of detector stages. Specifically, if the probability of detection at any one stage is p, the probability of detection after n stages is $1-(1-p)^{n+1}$.

Figure 4:
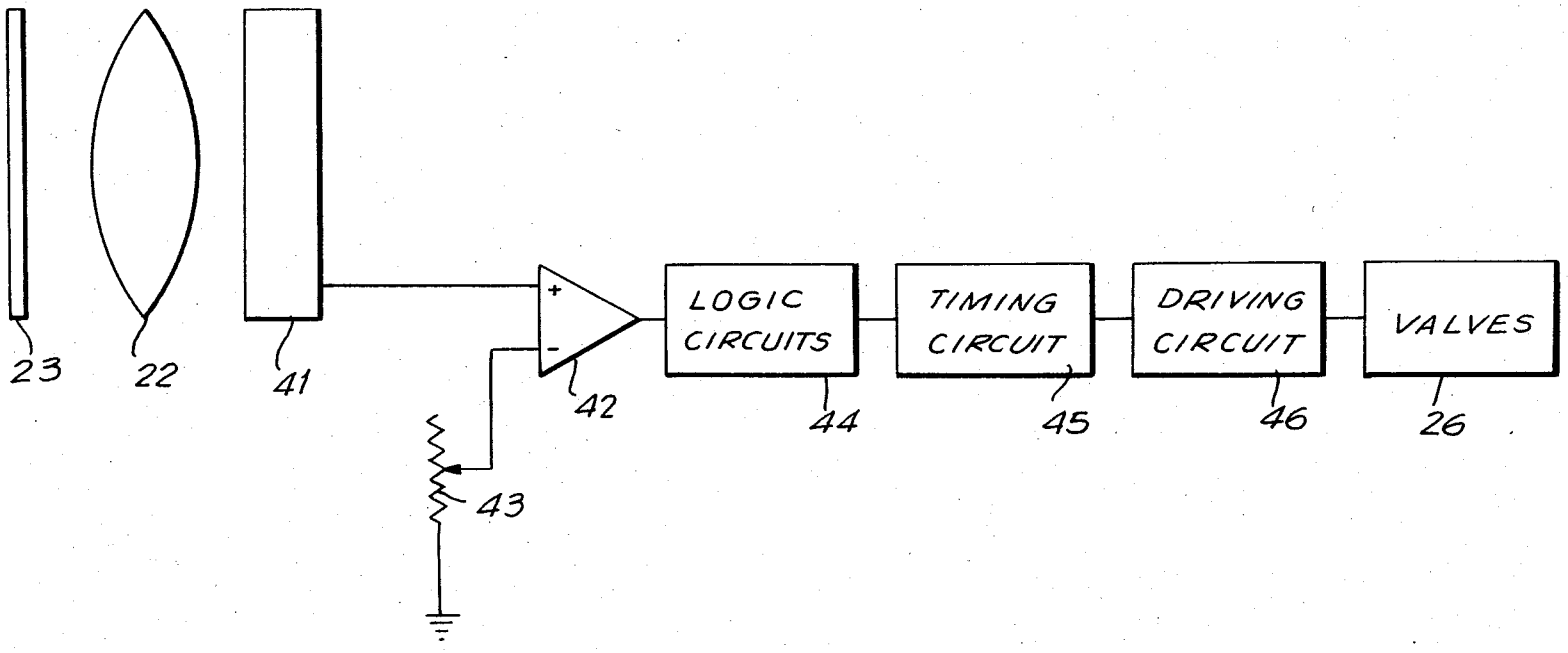
FIG. 4 is a schematic diagram of the electronics of the invention.

The optics and control circuitry 40 are shown schematically in FIG. 4. Detector 16 includes a one- or two-dimensional matrix of electro-optical elements which is preferably a line scan camera 21 having a linear photodiode array 41 of 1,024 elements. The minimum size of array 41 is determined by the requirement that for sufficient resolution the ratio of the size of the particle to be detected to the width of cascade 14 should correspond to two elements of the array. In other words, the number of elements is twice the ratio of the width of cascade 14 to the size of the particle to be detected. The actual number of elements is generally higher, giving greater resolution than necessary, based on factors including the focal length of lens 22 and the desired spacing between array 41 and cascade 14. Preferably the spacing of array 41 from cascade 14 and the focal length of lens 22 are selected so that an area 0.037 inches in height by 36 inches in width falls on array 41. Camera 21 is preferably capable of scanning this area in 1.2 msec. Previously known systems used at least two cameras to scan an area less than half as wide in the same time. Although the scan area of the previously known systems could be increased by simply moving the camera farther from the tobacco, that would necessitate an increase in lighting levels proportional to the square of the distance of the camera from the cascade, and the resolution achieved would be decreased. The present invention can therefore scan at least twice as much tobacco area in the same time as previously known systems. Further, as discussed above, for a given area scanned, apparatus 10 can scan a greater volume than previously known systems because cascade 14 eliminates the need to scan tobacco only in a monolayer. Apparatus 10 can handle a flow rate of tobacco of up to 12,000 lbs./hr., while previously known systems were restricted to 1000 lbs./hr. and under.

Electro-optical detector array 41 is preferably broken down into eight segments for processing purposes. Each of valves 26*a–h* corresponds to one segment. The signal from array 41 is fed to a comparator 42, adjustable at 43 for sensitivity, which determines when light is being reflected at levels which indicate the presence of foreign material. The output of comparator 42 is fed to logic circuits 44 which determine where the foreign material is present. Logic circuits 44 in turn activate valve timing circuit 45 which determines when to activate that one of valves 26*a–h* corresponding to the segment in which the foreign material is present based on the time required for a particle to reach the area of deflection bar 28 after passing camera 21, and which also controls the duration of the air blast. The output of timing circuit 45 is fed to valve driving circuit 46, which activates the appropriate valve. In a preferred embodiment, a blast of 48 msec duration will be initiated 64 msec after detection.

The processing of the detector information in segments provides a self-diagnostic capability for the apparatus. Logic circuits 44 can include accumulators to cumulatively total the number of particles of foreign material detected in each segment. Statistically, the same number of particles of foreign material should be detected in each segment over a long enough period of time. The totals in the accumulators can be compared and if any one total differs significantly from the others, a visible or audible warning can be provided to alert operating personnel that there may be a malfunction in the apparatus.

Foreign material is detected by comparing its reflectivity, which depends on a combination of color and surface properties, at a given wavelength to a reference level set above the known reflectivity of tobacco at that wavelength, so that even a particle of foreign material of the same color as tobacco will be detected if its reflectivity is higher than that of tobacco. The electro-optical detector array is sensitive to light with a wavelength in the range of from about 200 nm to about 1300 nm. The sensitivity of detector 16 to a particular foreign material or group of foreign materials can be enhanced by using filters and windows which transmit those wavelengths which are preferentially reflected by the foreign materials as compared to the tobacco and which absorb all other wavelengths. The effect of this is to greatly reduce the noise in the electronic signal from the detector.

Figure 5:
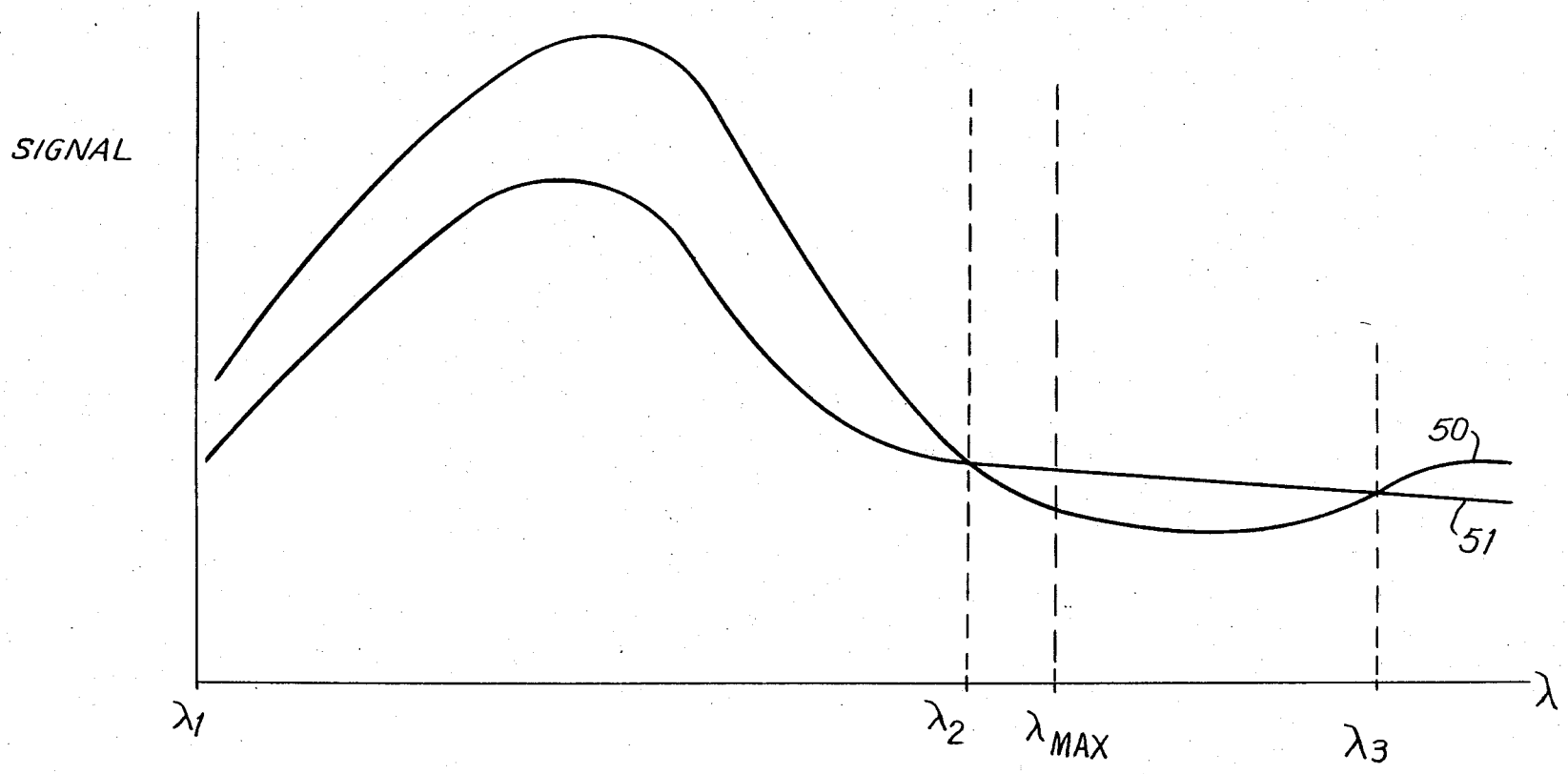
FIG. 5 is a plot of the wavelength responses of tobacco and a typical foreign material.

Different substances have different responses to different wavelengths of light. The reflectivities of tobacco and a typical foreign material are plotted schematically as a function of wavelength in FIG. 5. For optimum detection of foreign material, it is desirable that the detection system be most sensitive in that range of wavelengths in which the difference in reflectivity between the foreign matter (curve 50) and the tobacco (curve 51) is positive. As shown in FIG. 5, this range would be from $\lambda_1$ to $\lambda_2$ and filter 23 is selected for its ability to absorb radiation outside this range and its ability to transmit radiation efficiently in this range. The difference in reflectivity also increases beyond $\lambda_3$, but camera 21 is "blind" beyond $\lambda_{max}$.

The table below shows the wavelength responses of a variety of filters manufactured by Corning Glass Works:

| Filter Type and Thickness | Wavelengths Transmitted (nm) |
|---|---|
| Corning 4303 (5 mm) | 340–610 |
| 4784 (5 mm) | 340–680 |
| 5113 (5 mm) | 360–470 |
| 5543 (5 mm) | 350–520 |
| 9780 (5 mm) | 340–660 |
| 9782 (5 mm) | 350–610 |
| 9782 (2 mm) | 340–660 |

It has been found that in order to detect most common foreign materials, the Corning 9782 filter (5 mm thickness) should preferably be used. However, for specialized detection of particular foreign materials, it may be desirable to use other filters, as determined by the wavelength responses plotted in FIG. 5. If two detectors 16,16' are used, as described above, it may be desirable to use a different filter on each to detect different foreign materials.

In addition to spatial differences in color or reflectivity in a single scan of camera 16, control electronics 40 may be capable of detecting temporal changes from one scan to the next. For example, a half-inch particle falling at 250 ft./min. in cascade 14 is scanned approximately eight times in the time interval which it takes to fall through the 0.037 in. high field of view, presenting a changing area which has a different reflectivity than the surrounding tobacco. The variation from one scan to the next is a further indication that a foreign material has been detected.

The apparatus of the present invention can also be used to detect and remove foreign material from streams of particulate matter other than tobacco. One possible use is the detection and removal of foreign material from grain, such as wheat. Other uses will be apparent to one skilled in the art.

Thus, apparatus is provided which can effectively scan large volumes of particulate matter for the detection and removal of foreign materials. One skilled in the art will recognize that the inventive principles disclosed herein can be practiced other than by the described apparatus, which is presented only for the purposes of illustration and not of limitation, and the present invention is limited only by the claims which follow.

What is claimed is:

1. Apparatus for detecting foreign material in a stream of particulate matter, said apparatus comprising:

first conveying means for delivering a stream of particulate matter containing foreign material to said apparatus;

second conveying means located below and spaced vertically from said first conveying means for conveying said stream of particulate matter away from said apparatus, such that said stream of particulate matter is transferred from said first conveying means to said second conveying means by falling therebetween under the influence of gravity in a turbulent cascade;

illuminating means for illuminating said turbulent cascade of particulate matter while it is falling between said first and second conveying means;

detecting means for detecting light reflected from said illuminated turbulent cascade of particulate matter; and control means for comparing, without resort to a background reference, the light reflected from said illuminated turbulent cascade of particulate matter containing foreign material with the light expected to be reflected from a turbulent cascade of the particulate matter free of foreign material and for generating a signal when said reflected light indicates the presence of foreign material.

2. Apparatus for removing foreign material from a stream of particulate matter, said apparatus comprising:

first conveying means for delivering a stream of particulate matter containing foreign material to said apparatus;

second conveying means located below and spaced vertically from said first conveying means for conveying said stream of particulate matter away from said apparatus, such that said stream of particulate matter is transferred from said first conveying means to said second conveying means by falling therebetween under the influence of gravity in a turbulent cascade having first and second sides;

first illuminating means for illuminating said turbulent cascade of particulate matter while it is falling between said first and second conveying means;

first detecting means for detecting light reflected from said illuminated turbulent cascade of particulate matter;

control means for comparing, without resort to a background reference, the light reflected from said illuminated turbulent cascade of particulate matter containing foreign material with the light expected to be reflected from a turbulent cascade of the particulate matter free of foreign material and for generating a signal when said reflected light indicates the presence of foreign material;

first deflecting means responsive to said signal for directing a blast of fluid under pressure at a portion of said turbulent cascade of particulate matter when said control means determines that foreign material is present in said portion of said turbulent cascade of particulate matter, said blast of fluid deflecting said foreign material from said turbulent cascade.

3. The apparatus of claim 2 wherein said first illuminating means, said first detecting means and said first deflecting means are on said first side of said turbulent cascade at first illuminating, detecting and deflecting heights, respectively, said apparatus further comprising second illuminating means and second detecting means on said second side of said turbulent cascade, and deflecting means associated with said second detecting means, at second illuminating, detecting and deflecting heights, respectively.

4. The apparatus of claim 3 wherein said second detecting height is said first detecting height.

5. The apparatus of claim 3 wherein said second deflecting height is said first deflecting height and said deflecting means associated with said second detecting means is said first deflecting means.

6. The apparatus of claim 2 wherein said first illuminating means, said first detecting means and said first deflecting means are on said first side of said turbulent cascade at first illuminating, detecting and deflecting heights, respectively, said apparatus further comprising second illuminating means, second detecting means and second deflecting means on said first side of said turbulent cascade at second illuminating, detecting and deflecting heights, respectively.

7. The apparatus of claim 2 wherein said first conveying means is an inclined vibrating conveyor.

8. The apparatus of claim 2 wherein the wavelength of said first illuminating means is selected to be optimally in a range wherein the difference between the reflectivity of foreign material and the reflectivity of the particulate matter is positive.

9. The apparatus of claim 2 wherein said first detecting means has an optimum wavelength response in the range of wavelengths wherein the difference between the reflectivity of foreign material and the reflectivity of the particulate matter is positive.

10. The apparatus of claim 9 wherein said first detecting means comprises:

an matrix of electro-optical detectors having an optimum wavelength response in said range of wavelengths; and a filter located between said cascade and said matrix, said filter being transmissive to light in said range of wavelengths and substantially non-transmissive to light outside said range of wavelengths.

11. The apparatus of claim 10 wherein said matrix comprises a linear photodiode array.

12. The apparatus of claim 11 wherein said linear photodiode array comprises a number of elements selected so that a particle of the minimum size desired to be detected will be within the field of view of at least two of said elements.

13. The apparatus of claim 2 wherein:

said detecting means scans a field spanning the width of said turbulent cascade, said field being divided into a plurality of zones; and said control means comprises:

accumulator means for cumulatively totalling the number of particles of foreign material detected in each of said zones, and means for indicating when the number of particles of foreign material detected in one of said zones differs significantly from the number of particles of foreign material detected in others of said zones, thereby indicating a possible malfunction of said apparatus.

14. The apparatus of claim 2 wherein said first deflecting means comprises a plurality of valves responsive to said control means for releasing said fluid under pressure.

15. The apparatus of claim 14 wherein said fluid is a gas.

16. The apparatus of claim 15 wherein said gas is air.

17. The apparatus of claim 14 wherein said detecting means scans a field spanning the width of said turbulent cascade, said field being divided into a plurality of zones, and the number of said plurality of valves is equal to the number of said plurality of zones, each of said valves deflecting foreign material from a corresponding one of said zones.

18. A method for removing foreign material from a stream of particulate matter containing foreign material, said method comprising the steps of:

causing said stream of particulate matter containing foreign material to fall under the influence of gravity in a turbulent cascade having first and second sides;

illuminating a first side of said turbulent cascade of particulate matter at a first illuminating height;

detecting the light reflected from said illuminated turbulent cascade of particulate matter at a first detecting height;

comparing, without resort to a background reference, the light reflected from said illuminated turbulent cascade of particulate matter containing foreign material at said first detecting height with the light expected to be reflected from a turbulent cascade of the particulate matter free of foreign material, and generating a first signal when said reflected light indicates the presence of foreign material; and deflecting a first portion of said turbulent cascade at a first deflecting height in response to said first signal.

19. The method of claim 18 further comprising the steps of:

illuminating said second side of said turbulent cascade of particulate matter at a second illuminating height;

detecting the light reflected from said illuminated turbulent cascade of particulate matter at a second detecting height;

comparing, without resort to a background reference, the light reflected from said illuminated turbulent cascade of particulate matter containing foreign material at said second detecting height with the light expected to be reflected from a turbulent cascade of the particulate matter free of foreign material and generating a second signal when said reflected light indicates the presence of foreign material; and deflecting a second portion of said turbulent cascade at a second deflecting height in response to said second signal.

20. The method of claim 19 wherein said second detecting height is said first detecting height.

* * * * *

UNITED STATES PATENT AND TRADEMARK OFFICE

CERTIFICATE OF CORRECTION

PATENT NO. : 4,657,144

DATED : April 14, 1987

INVENTOR(S) : Peter Martin et al.

It is certified that error appears in the above-identified patent and that said Letters Patent is hereby corrected as shown below:

Cover page, at [56] References Cited, after: "3,901,388 8/1975 Kelly ..... 209/111.7" should be inserted:
-- 4,056,643 11/1977 Hansen, Jr. ..... 209/111.7 R --;

after "2119509 11/1983 United Kingdom ." should be inserted:
--

OTHER PUBLICATIONS

AMF/Legg Proposal For Electronic Reclaimed Tobacco Sorter, November 1982

AMF/Legg Paper Sorter Set-up Instructions

AMF/Legg ALICE III Automatic Leaf Inspection and Conveying Equipment brochure

Gunson's Sortex Ltd. Optical Colour Sorter brochure

Gunson's Sortex Ltd. Sortex 425C Optical Colour Sorter brochure

Gunson's Sortex Ltd. Sortex 962 Optical Colour Sorter brochure

Gunson's Sortex Ltd. Sortex 1212 Bulk Sorter brochure

Gunson's Sortex Ltd. Sortex 1421 brochure

UNITED STATES PATENT AND TRADEMARK OFFICE

CERTIFICATE OF CORRECTION

PATENT NO. : 4,657,144

DATED : April 14, 1987

INVENTOR(S) : Peter Martin et al.

It is certified that error appears in the above-identified patent and that said Letters Patent is hereby corrected as shown below:

Gunson's Sortex Ltd. Commodity List of products sorted and separated on Sortex Optical Colour Sorting Machines Gunson's Sortex Ltd. Sortex 1161 Optical Colour Sorter brochure --.

Claim 10, line 3, "an" (first occurrence) should be -- a --.

Signed and Sealed this

Thirteenth Day of September, 1988

*Attest:*

DONALD J. QUIGG

*Attesting Officer*

*Commissioner of Patents and Trademarks*